US005080028A

United States Patent [19]

Ingram

[11] Patent Number: 5,080,028

[45] Date of Patent: Jan. 14, 1992

[54] APPARATUS FOR PRODUCING TUFTED GOODS USING YARNS OF DIFFERENT COLOR OR TEXTURE

[75] Inventor: Gary L. Ingram, Ooltewah, Tenn.

[73] Assignee: Tapistron International, Inc., Ringgold, Ga.

[21] Appl. No.: 625,949

[22] Filed: Dec. 11, 1990

Related U.S. Application Data

[63] Continuation-in-part of Ser. No. 366,545, Jun. 15, 1989, Pat. No. 4,991,523.

[51] Int. Cl.[5] ..... D05C 15/18

[52] U.S. Cl. ..... 112/80.08; 112/80.73

[58] Field of Search ..... 112/80.05, 80.08, 80.16, 112/80.31, 80.6, 80.7, 80.71, 222, 266.2, 80.73, 80.5, 80.07

[56] References Cited

U.S. PATENT DOCUMENTS

| | | | |
|---|---|---|---|
| 3,160,125 | 12/1964 | Bryant et al. | 112/80.7 X |
| 3,986,465 | 10/1976 | Smith et al. | 112/80.7 X |
| 4,151,805 | 5/1979 | Long et al. | 112/80.7 |
| 4,244,309 | 1/1981 | Spanel et al. | 112/80.07 |
| 4,549,496 | 10/1985 | Kile | 112/80.08 |
| 4,991,523 | 2/1991 | Ingram | 112/80.05 |

*Primary Examiner*—Werner H. Schroeder
*Assistant Examiner*—Paul C. Lewis
*Attorney, Agent, or Firm*—Alan Ruderman

[57] ABSTRACT

Apparatus for producing tufted textile goods employs a plurality of hollow needles which serve as backing openers, the backing openers being carried on a widthwise extending member which is reciprocated in a vertical direction to cause the backing openers to penetrate a backing. Yarn is transported pneumatically through the backing openers and implanted into the backings as yarn tufts, the backing being shifted in the transverse direction by an amount corresponding to the spacing between adjacent backing openers in order to implant a transverse row of tufts. Each yarn is trained about a feed roller which is selectively moved into peripheral engagement with a drive roller when the yarn is to be fed to the needle. The yarn transverses a path from the feed roller to the needle which includes a yarn clamp and a yarn pullback mechanism. When yarn is being fed the clamp is released and the pullback mechanism provides a first path for the yarn to travel to the needle, but when that yarn is no longer to be fed to that needle, but when that yarn is no longer to be fed to that needle, the clamp is actuated to clamp the yarn and the pullback mechanism thereafter draws the yarn back from the needle into a second and longer path, and the feed roller is disengaged from the drive roller. A knife blade is associated with each backing opener and positioned on the opposite side of the backing so as to engage the flat angled surface of the backing opener which forms its pointed tip.

20 Claims, 3 Drawing Sheets

APPARATUS FOR PRODUCING TUFTED GOODS USING YARNS OF DIFFERENT COLOR OR TEXTURE

REFERENCE TO RELATED APPLICATIONS

This application is a continuation-in-part of copending application Ser. No. 07/366,545 filed June 15, 1989, now U.S. Pat. No. 4,991,523 dated Feb. 12, 1991.

BACKGROUND OF THE INVENTION

This invention relates generally to apparatus for producing tufted textile goods such as carpet, upholstery, and the like, and more particularly to improved tufting apparatus capable of producing patterned tufted goods.

U.S. Pat. No. 4,549,496 which issued Oct. 29, 1985, to Kile discloses highly advantageous tufting apparatus for producing patterned tufted goods using yarns of different colors or different textures. This apparatus is capable of placing yarn into a backing to create patterns and designs which previously were generally available only from a weaving loom or by using printing techniques. The patented apparatus employs multiple heads spaced across the width of a backing material. Each head comprises a reciprocating backing opener tube for penetrating the backing and for implanting yarn tufts in the backing by feeding yarn through the tube pneumatically. The backing opener is connected to a yarn exchanger into which a plurality of yarns of different colors, for example, are supplied, and a mechanism is included which enables the selection of one or more of the yarns for implantation into the backing for each penetration by the backing opener. The multiple heads are stepped in synchronism across the backing for a distance corresponding to the spacing between the heads in order to implant a transverse row of yarn tufts. The backing is then advanced to the position of the next row and the process is repeated to implant the next row. A computer controls the selection of the yarn implanted by each backing opener for each penetration of the backing in order to produce a desired pattern in the finished goods.

Although the patented apparatus represents a significant advancement in the tufting industry in that it has enabled the production of multicolored and patterned tufted goods at a substantially reduced cost and in a substantially shorter period of time than is possible with conventional weaving looms, it is desirable to improve tufting apparatus embodying the patented invention to reduce costs and further increase production speed. One area in which improved efficiency is desired in practical apparatus embodying the patented invention is in the mechanism which cuts the yarn after it has been implanted into the backing. This was addressed in the aforesaid copending U.S. application Ser. No. 07/366,545 filed June 15, 1989, which disclosed an improved yarn cutting mechanism having significant advantages over that disclosed in the Kile patent by providing a cutting mechanism wherein a cutting blade cooperates with the backing opener tube or needle and shears the yarn as the hollow needle reciprocates into shearing engagement with the blade and the blade acts against the angled surface forming the needle point. Additionally, the cutting apparatus disclosed in the aforesaid copending patent application includes mechanism for permitting the yarn to be selectively cut or not cut as desired so that loop pile, cut pile, and cut/loop pile fabrics may be produced.

A significant factor influencing the production speed of practical apparatus embodying the invention of the Kile patent is the number of tufting heads embodied in the apparatus. The greater the number of heads, the less distance each head must traverse and, accordingly, the faster a row of tufts can h=implanted in the backing. As the number of heads increases, however, other problems arise. The increased weight makes it more difficult to move the heads accurately and to maintain their alignment and positions relative to one another. Additionally, in the aforesaid patent application rather than the multiple heads which carry the hollow needle being moved across the backing, the backing is shifted transversely so that substantially less weight is moved transversely which not only simplifies the transverse shifting apparatus but also provides greater accuracy to the yarn placement.

A significant factor influencing the cost and accuracy of tufting apparatus embodying the invention of the Kile patent is the control over the feeding of the yarn to the hollow needle. The feeding of the yarn must be positive, and when a yarn change is to be made for a particular needle the yarn previously stitched by that needle should be positively withdrawn from the needle so that the subsequent yarn will not be blocked by the previously sewn yarn. Unless this withdrawal of the previously sewn yarn is assured, a substantially greater air pressure is required to supply the subsequent yarn through the needle. Greater pressure requirements, of course, result in larger compressers and more costly machine and production costs. Additionally, when the yarn is withdrawn from the needle, unless the yarn withdrawal is controlled, the next time that yarn is required to be fed to the needle an accurate and consistent length of yarn can not be assured. This would result in requiring additional pressure to assure that a sufficient length of yarn is supplied. The effect is that a larger than required amount of pressure must be utilized, and if too much yarn is supplied to the needle additional yarn shearing operations are required for producing a satisfactory product. The additional pressure results in increased cost, as does the additional shearing operations.

It is desirable to provide tufting apparatus which avoids the foregoing problems and which affords further improvements in tufting apparatus of the type disclosed in the Kile patent, and it is to these ends that the present invention is directed.

SUMMARY OF THE INVENTION

In accordance with the present invention the yarn feed apparatus includes a pullback mechanism that assures that a previously fed yarn is drawn back a controlled amount from the hollow needle or backing tube opener to preclude restriction of the feeding of a subsequent yarn each time a yarn change is made. Additionally, the present invention assures that when the yarn is pulled back from the hollow needle, yarn is not pulled from the yarn supply direction.

To these ends, the yarn feed apparatus of the present invention includes a pullback mechanism disposed between a yarn feed roller and the hollow needle, the pullback mechanism acting to pull the yarn a preselected amount from the needle so that the yarn passageway in the needle is not restricted by the previous yarn when a subsequent yarn is to be sewn. Additionally, to assure that the pullback mechanism draws yarn from the needle and not from the yarn supply or the feed roller, clamping apparatus is disposed between the yarn feed roller and the pullback mechanism. The clamping apparatus positively clamps the yarn when a yarn change is to be made. The pullback mechanism is thereafter activated and the yarn feed roller ceases positive feeding of the yarn. Thus, the yarn pullback mechanism draws a predetermined amount of yarn from the needle maintaining it in reserve until again required. Additionally, the yarn feed roller as it ceases positive feeding draws a preselected amount of yarn from the yarn supply for immediate subsequent use when needed. When the needle is to commence stitching with a particular yarn, the yarn feed roller is activated and the yarn clamping apparatus and yarn pullback mechanism are deactivated.

BRIEF DESCRIPTION OF THE DRAWINGS

The particular features and advantages of the invention as well as other objects will become apparent from the following description taken in connection with the accompanying drawings, in which.

DESCRIPTION OF PREFERRED EMBODIMENTS

As previously indicated, the present invention is especially adapted for use with apparatus for producing tufted textile goods, such as carpet, wall coverings, or upholstery, and affords improved tufting apparatus of the type disclosed in the previously referenced U.S. Pat. No. 4,549,496 to Kile, the disclosure of which is incorporated by reference herein. Details of structure and operation of the improved tufting apparatus of the present invention which are not directly related to the present invention and which are described in the Kile patent will not be repeated here. Rather, reference may be had to the Kile patent for the details of such structure and operation.

Figure 1:
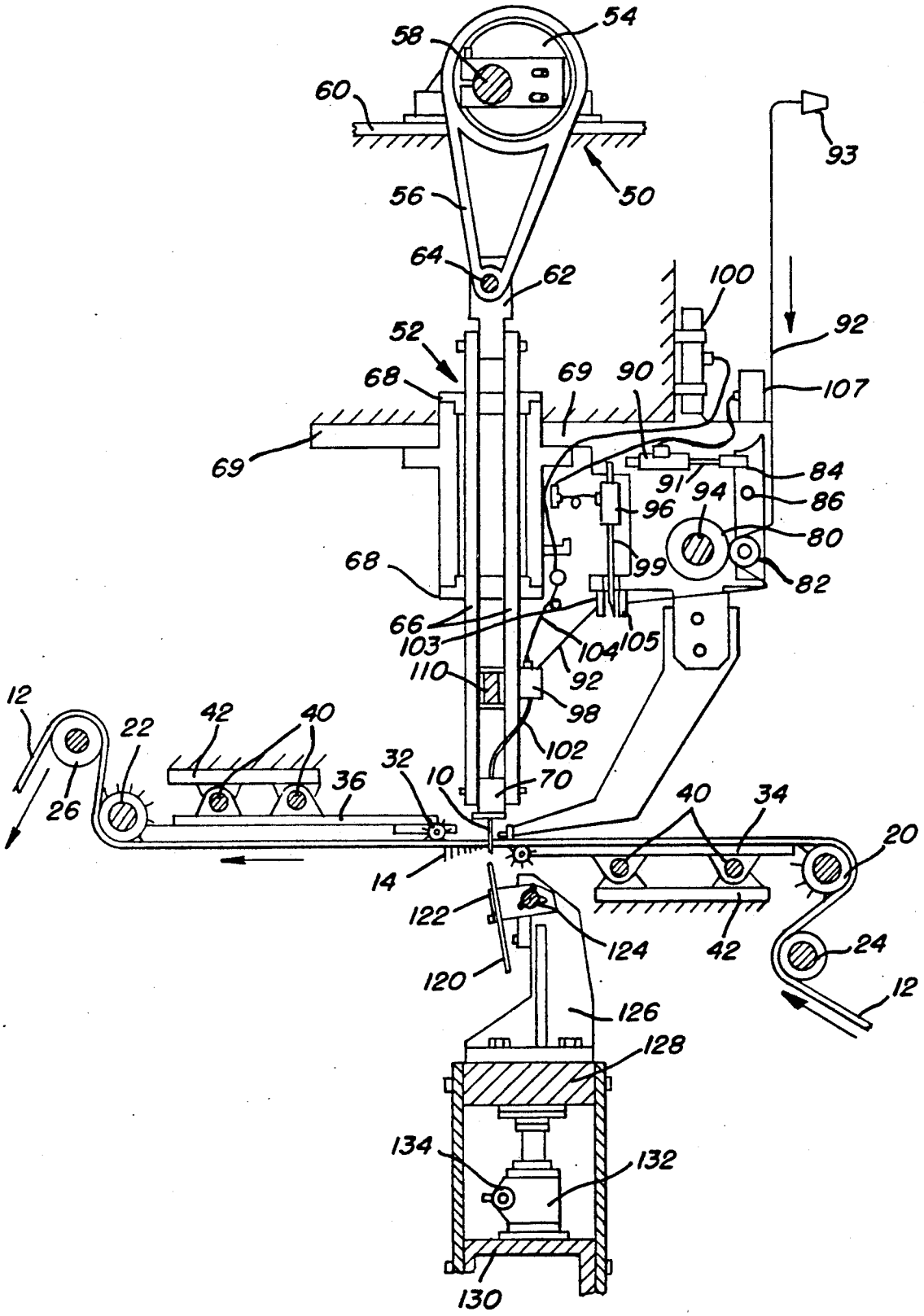
FIG. 1 is a longitudinal side view, partially in cross section and partially diagrammatic, of tufting apparatus embodying the invention.

FIG. 1 is a longitudinal side view, partially in cross section and partially diagrammatic, illustrating improved tufting apparatus in accordance with the invention. The tufting apparatus of FIG. 1 may comprise a reciprocating backing opener tube 10 (hereinafter referred to as a backing opener or needle since it is a hollow needle) for penetrating a primary backing 12 to implant yarn tufts 14 therein. The primary backing 12, which may be in the form of a continuous running web, for example, may be advanced longitudinally past the reciprocating backing opener (to the left in FIG. 1 as indicated by the arrow) by a backing advance system which may comprise a pair of pin rollers 20 and 22 which are driven (as by electric motors which are not illustrated) at slightly different rotational speeds so as to maintain the backing under tension as it passes the reciprocating backing opener. The backing advance system may further comprise a pair of guide rollers 24 and 26 which cooperate with pin rollers 20 and 22, respectively, to guide the backing. As shown in the figure and for reasons which will be described in more detail shortly, a second pair of pin rollers 30 and 32, which may have smaller diameters than pin rollers 20 and 22, may be located closely adjacent to the reciprocating backing opener 10 on opposite sides of the backing. Pin rollers 30 and 32 provide better control of the backing in the area where the tufts are implanted. As shown in the figure, pin roller 30 may be carried on a bed plate 34 at the lower side of the backing and be disposed adjacent to the location at which the backing opener penetrates the backing. Pin roller 32 may be carried on a second plate 36 disposed at the upper side of the backing and be located just downstream from the reciprocating backing opener. Plates 34 and 36 are preferably transversely shiftable for reasons which will be described.

Pin rollers 20 and 22 may also be carried on the shiftable plates 34 and 36, respectively, as indicated in the figure. To enable movement each of the plates 34 and 36 may be carried on a pair of transversely extending shafts 40 which are supported by fixed portions 42 of the frame of the apparatus. Plates 34 and 36 may be mechanically connected together and to a transverse positioning mechanism (not illustrated) which enables the plates as well as the pin rollers and their associated drive system to be shifted in unison transversely to the direction of advancement of the backing. This produces a corresponding transverse shifting movement of the backing, which is desirable for reasons which will be described shortly. The transverse positioning mechanism may be any of a number of commercially available devices, such as pneumatic hydraulic cylinders, or a ball screw drive which are capable of producing very small and precisely controlled movements. Preferably, the positioning mechanism enables precisely controlled movements of the order of a tenth of an inch or less. Rollers 24 and 26 may also be shifted transversely along with pin rollers 20 and 22. This may be accomplished by a second, less precise shifting mechanism.

Backing opener 10 may be reciprocated by an adjustable cam assembly 50 which is coupled to the backing opener by a link assembly 52. The adjustable cam assembly may comprise a circular cam lobe member 54 rotatably supported by bearings within a circular portion of a yoke member 56. The cam lobe member may be carried on and driven by a transversely extending rotating shaft 58 which is offset from the center of the cam lobe member. Shaft 58 may be supported by bearings on a fixed portion 60 of the frame as shown. The link assembly may comprise a coupling link 62 which is pivotally connected to yoke member 56 as shown at 64 and connected to a pair of vertically extending link members 66 which are guided for vertical reciprocating movement by linear bearings 68 supported by other fixed portions 69 of the frame. The lower ends of link members 66 are connected to a yarn exchanger 70 which carries the backing opener 10. Upon rotation of shaft 58, cam lobe member 54 rotates to impart reciprocating movement to yoke member 56 and, in turn, a similar movement to the backing opener via the link assembly to cause the backing opener to penetrate the backing repetitively.

Figure 3:
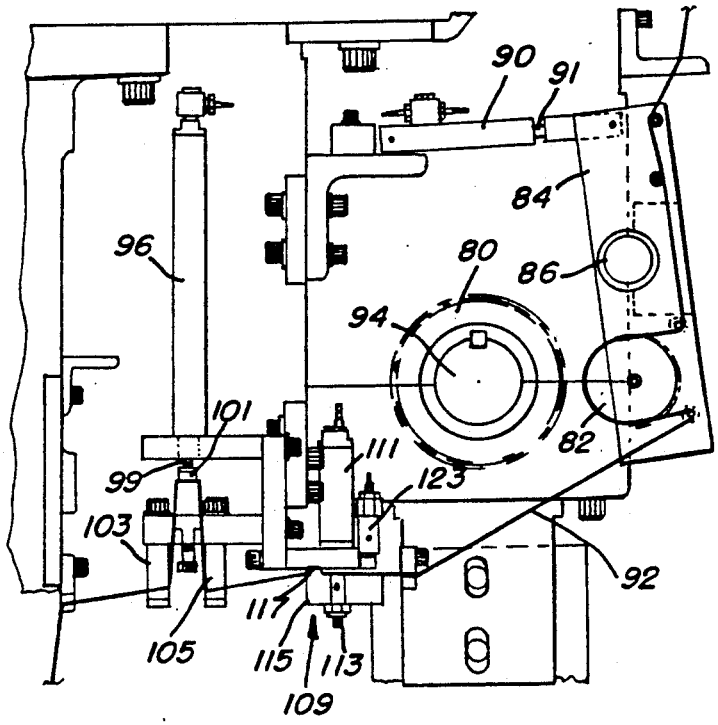
FIG. 3 is a partial elevational side view of the yarn feed apparatus illustrated in FIG. 1, greatly enlarged, and including the yarn clamping apparatus, the yarn feed apparatus being illustrated in the non-feeding mode.
Figure 4:
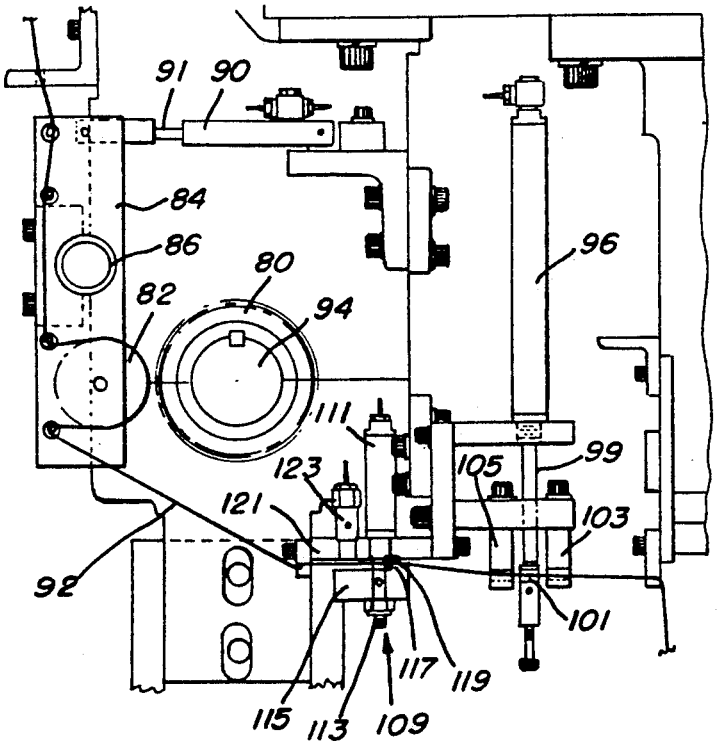
FIG. 4 is a view similar to FIG. 3 illustrating similar yarn feed apparatus with the elements in the yarn feeding mode, the apparatus in FIG. 4 being disposed at the rear of the tufting apparatus for controlling a different needle.

As described in the aforesaid copending patent application Ser. No. 07/366,545, the tufting apparatus of FIG. 1 also includes systems for supplying and controlling the yarn which is implanted into the backing. These systems include a yarn feed system for positively supplying a predetermined length of selected yarn to the yarn exchanger for each needle. The yarn feed system comprises a drive roller 80 which cooperates with a feed roller 82 carried on a movable member 84 which is pivotably supported on a journal member 86 on the frame portion 69, there being one roller 82 carried on a member 84 for each yarn supplied to each needle or backing tube opener. Each feed roller 82 may be urged into engagement with a respective drive roller 80, which may be a single roller for a number of feed rollers, by means of a respective pneumatic actuator 90 or the like which is connected to the pivotable member 84 by means of a rod 91 extendable and rectractable from the actuator 90 so as to pivot the member 84 to urge the respective rollers 80 and 82 into contact with one another. Yarn 92 fed from a yarn supply such as a yarn cone 93 mounted on a creel (not illustrated) may be guided around the periphery of roller 82 so as to be between the engaging peripheral surfaces of rollers 80 and 82. The drive roller 80 may be supported on an incrementally rotated drive shaft 94 so that upon the shaft being rotated with the rollers 80 and 82 engaged, yarn is positively fed to the yarn exchanger 70 via a yarn pullback mechanism 96 and via a yarn ejector device 98. Thus, the yarn is trained so as to make a tortuous path about the roller 82 thereby resulting in a predetermined length of yarn being drawn from the yarn supply as the member 84 is pivoted to disengage the roller 82 from the roller 80 as illustrated in FIG. 3. The yarn so drawn from the supply is thereafter ready for feeding toward the needle when the member 84 is again pivoted to engage the roller 82 with the roller 80 as illustrated in FIG. 4.

The yarn pullback mechanism 96 includes a rod or plunger 99 having a passageway or eyelet 101 which moves relative to a pair of yarn guides 103, 105, fixed to the frame, and the plunger 99 is disposed between the yarn guides 103, 105. This mechanism, as hereinafter described, acts to retract yarn from the needle or backing opener tube 10 after a stitch has been formed and cut by the cutting apparatus described in the aforesaid copending application, the yarn preferably being pulled into the yarn exchanger 70. A yarn ejector device 98 associated with each needle receives a plurality of different yarns (only one yarn 92 being illustrated in the drawings), each yarn having a separate passageway, along with pressurized air directed into each passageway from a pneumatic supply device 100. The supply device 100 supplies high pressure air to the passageway having yarn that has been selected for ejection into the needle or backing tube opener and supplies low pressure air to the other passageways, the pressure selection being by pressure regulators and control means (not illustrated). Each yarn strand entering the ejector device 98 is fed to the yarn exchanger 70 through a separate supply tube 102 which connects the ejector device to the yarn exchanger. A separate air line 104 for each yarn tube 102 is connected to the ejector device 98 to enable compressed air to be ejected into each yarn passageway in a controlled manner selectively to transport the selected yarn pneumatically under the higher pressure through the tube to the backing opener. The low pressure air supplied to the ejector 98 and thus the other air supply tubes ensure that the other yarns are available without delay after another respective yarn has been selected to be transported to the needle or backing tube opener. Additionally, the same or preferably, another pneumatic supply 107 may supply pressurized air to the actuator 90 and the pullback mechanism 96.

The yarn ejector device 98, yarn supply tubes 102 and yarn exchanger 70 together function in a similar manner to the yarn exchanger described in the Kile patent and operate in a similar manner, the difference being that in the Kile patent the yarn exchanger and the yarn ejection device were incorporated into a common unit. A particular yarn may be selected for implantation into the backing by appropriately controlling the air supplied to the respective pneumatic actuator 90 to pivot the member 84 associated with the selected yarn so that the corresponding feed roller 82 is moved into engagement with the drive roller 80; by controlling the air supplied to the yarn pullback mechanism 96 to extend the plunger 99 and release the yarn previously drawn from the yarn supply; and by controlling the compressed air supplied to the ejector device 98 to transport the selected yarn to the yarn exchanger. As illustrated in FIGS. 3 and 4, which show a yarn supply and control system respectively at the rear and front of the tufting apparatus, and which are identical but disposed for controlling different backing tube openers or needles (not illustrated in these figures), when the actuator 90 is actuated to extend the rod 91, as illustrated in FIG. 4, the member 84 is pivoted to force the roller 82 against the roller 80 so that the yarn 92, which initially is the yarn held in reserve, is fed toward the respective needle or backing opener tube. Additionally, the plunger 99 is extended from the pullback mechanism 96 so that the eyelet or passageway 101 permits the yarn to be fed toward the needle or backing opener tube, the extension of the rod 91 and the plunger occurring substantially simultaneously. When the actuator 90 is controlled to retract the rod 91, as illustrated in FIG. 3, the member 84 is pivoted to disengage the roller 82 from the roller 80 and terminate the feeding of the previously fed yarn. Also, the plunger 99 is retracted into the pullback mechanism to draw back yarn that has been fed but not used by the needle and held ready, as in a storage tank or plenum, until that yarn is again fed.

The purpose of the pullback mechanism 96 is to ensure that a previously fed yarn is drawn back into the vicinity of, and preferably into, the yarn exchanger 70 so that a blockage does not occur within the needle or backing tube opener 10 which would restrict the feeding of the subsequently fed yarn. This permits substantially less air pressure to be required to feed the yarn from the yarn exchanger to the needle or backing opener tube. To ensure that the pullback mechanism draws yarn back from the needle rather than from the yarn supply, and to preclude any yarn from being drawn from the reserve resulting when the feed roller 82 is moved out of engagement with the drive roller 80, the present invention also includes a clamping means 109. The clamping means 109 includes an actuator unit 111 having a rod 113 to which a clamping block 115 is secured. The clamping block 115 has a protuberance 117 at the upper surface thereof, the protuberance 117 being receivable within a notch formed in a fixed plate 121 when the rod 113 is retracted into the actuator unit 111, the plate 121 being that to which the actuator 111 is fastened. The actuator unit 111 is fed with a controlled supply of air from the pneumatic supply 107.

When yarn is fed by the yarn supply system, the rod 113 of the actuator unit 111 is extended substantially simultaneously with the extension of the plunger 99 and the rod 91 to permit the yarn to be fed to the needle or backing tube opener 10. After the yarn that has been fed has formed one or more stitches and it is desired to change to another yarn, and prior to retraction of the first yarn by the pullback mechanism, the actuator unit 111 is deactivated to retract the rod 113 resulting in the yarn being clamped between the protuberance 117 and the notch 119 as illustrated in FIG. 3. A mechanical exhaust valve 123 is disposed on the plate 121 and when the clamp block 115 is retracted to the clamping position, after the yarn is clamped the valve 123 acts to exhaust the actuator 90 and the yarn pullback mechanism 96. The valve 123 thus signals the actuator 90 and the pullback mechanism 96 and functions as a signaling means. When the pullback mechanism plunger 99 is thereafter retracted, all of the yarn that is pulled back to the yarn exchanger comes from the needle or backing tube opener. This not only ensures that the yarn is not pulled from the yarn supply, except by the roller 82 in moving from the roller 80, and controls the amount of yarn that is pulled from the needle or backing tube opener, but also ensures that the extra yarn drawn by the roller 82 when moving from the roller 80 is available to be supplied to the needle or backing tube opener. This compensates for the stretching and resiliency characteristics of the yarn which could result in not enough yarn being fed to the needle or backing tube opener for the subsequent stitch made by that yarn.

The tufting apparatus described in the Kile patent employs a plurality of tufting heads which are stepped transversely in synchronism across the backing In contrast, the tufting apparatus in FIG. 1 may employ a plurality of transversely stationary backing openers which may be connected together, as by a transversely extending bar 110 The apparatus may employ several adjustable cam assemblies 50 spaced transversely across the width of the backing and connected to shaft 58 to reciprocate the backing openers in synchronism to penetrate the backing. Each backing opener implants one or more selected yarns as determined by a control system such as a computer which controls the yarn supplying and control systems of the apparatus. In order to implant a transverse row of tufts, the backing is shifted transversely, as previously described, in small increments corresponding to the spacing between adjacent tufts By using a large number of backing openers with a relatively small spacing between adjacent backing openers, e.g. 2.5 inches, the backing need be shifted transversely only by this rather small total distance in order to implant a complete transverse row of tufts. The combination of the shifting large diameter pin rollers 20 and 22 and the small diameter pin rollers 30 and 32 spaced closely adjacent to the backing opener region afford good control over the backing as it is shifted transversely and avoid any tendency of the backing to skew. Rollers 24 and 26, which respectively guide the backing onto pin roller 20 and from pin roller 22, may also be shifted transversely by a separate shifting mechanism as previously indicated which need not be as precisely controlled as the mechanism which shifts the plates and pin rollers in the region where the backing is being tufted.

As previously noted, this backing shifting arrangement has a number of advantages over the earlier moving head apparatus of the Kile patent. It enables the relatively heavy and complex moving heads of the earlier apparatus to be eliminated. This simplifies the apparatus, affords closer control over the positions of the backing openers and avoids the possibility of relative movements between the backing openers, and increases production speed.

Figure 2:
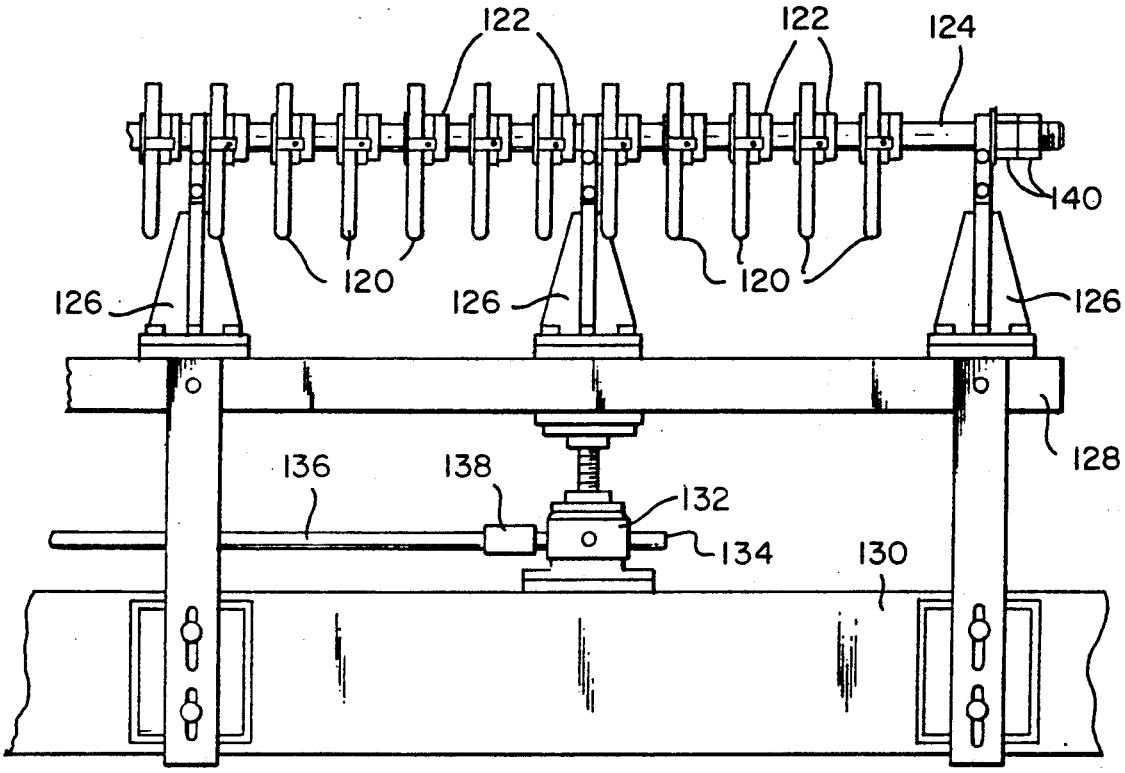
FIG. 2 is a transverse side view of a portion of a knife block assembly of the apparatus of FIG. 1.

Another significant aspect of the apparatus of FIG. 1 is the improved yarn-cutting mechanism of the invention which results in little or no wasted yarn in the production of cut pile goods. As shown in FIGS. 1 and 2, and as described in detail in the aforesaid U.S. Patent application Ser. No. 07/366,545, the improved tufting apparatus may include a cutting mechanism comprising a separate knife blade 120 for each needle or backing opener. The blades are disposed on the opposite side of the backing from the yarn exchangers and the reciprocating mechanism for the backing openers, as indicated in FIG. 1, and are arranged to cooperate with the needles or backing openers by sliding over the angled surfaces which form the pointed tips of the hollow needle or backing opener in a shearing-like action to cut yarn that is ejected from the backing openers.

As shown in FIGS. 1 and 2, knife blade 120 may comprise a flat elongated strip of metal, such as steel, which is held clamped in a knife block 122 disposed on a transversely extending keyed shaft 124. As best illustrated in FIG. 2, shaft 124 may be supported by several transversely spaced brackets 126 connected to a transversely extending frame member 128. Brackets 126 may clamp tightly to shaft 124 to prevent movement of the shaft. Frame member 128 is preferably supported on a fixed member 130 of the apparatus frame by several screwtype jacks 132 (only one being shown in the figures) which are spaced transversely the width of the apparatus. The control shafts 134 of the jacks may be connected together by control rods 136 and bushings 138, as shown, so that the jacks may be lowered and raised in unison to adjust the positions of the knife blades relative to the backing. Normally, shaft 124 may be held stationary by the brackets 126. The ends of the shaft may be threaded and clamped against a corresponding end bracket 126 by a pair of nuts 140, as shown in FIG. 2 for the left end of the shaft. The nuts and the supporting brackets prevent the shaft from rotating or moving in a transverse direction and hold the shaft stationary. Upon loosening the clamp brackets 126 and nuts 140, the shaft may be rotated in order to change the angle between the knife blade and the backing opener and the force with which the blade contacts the backing opener, as well as to shift the knife blades transversely a small amount relative to the backing openers. This shifting varies the region of the knife blade contacted by the backing opener to compensate for dulling of the knife blade caused by repeated engagement between the knife blade and the backing opener. Although the knife blades and needles are preferably formed of hardened steel or other suitably treated material to afford long wearing operation, the blades may become dull during use, and the arrangement shown in FIG. 2 permits the needles to be shifted a small amount to compensate for such dulling.

Numerous alterations of the structure herein disclosed will suggest themselves to those skilled in the art. However, it is to be understood that the present,disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An apparatus for feeding a yarn from a yarn supply to a reciprocating needle selectively requiring said yarn, a driven roller, a yarn feed roller disposed for movement into and out of peripheral engagement with said driven roller, means for guiding said yarn about said feed roller intermediate peripheral surfaces of said rollers, means for moving said feed roller into and out of engagement with said driven roller selectively to feed the yarn in a path from said feed roller toward said needle when said rollers engage, and a yarn pullback mechanism disposed intermediate said feed roller and said needle for permitting said yarn to be fed toward said needle when the yarn is fed by said feed roller and having means movable independently of said feed roller for drawing yarn back from said needle after a stitch has been formed by said needle and said needle no longer requires the yarn, said pullback mechanism including storage means for maintaining drawn yarn for subsequent use as required by said needle.

2. In apparatus as recited in claim 1, wherein said pullback mechanism includes a movable passageway through which said yarn is threaded, and means for moving said movable passageway to shorten the path of said yarn from said feed roller to said needle when said yarn is fed toward said needle and to increase said path when said yarn is not fed toward said needle.

3. In apparatus as recited in claim 1, including clamping means disposed intermediate said feed roller and said pullback mechanism for clamping said yarn when not fed by said roller and for releasing said yarn when fed by said roller.

4. In apparatus as recited in claim 2, including clamping means disposed intermediate said feed roller and said pullback mechanism for selectively clamping said yarn prior to moving said movable passageway to increase said path and for unclamping and releasing said yarn when said path is shortened by said movable passageway.

5. In apparatus as recited in claim 4, including signaling means associated with and activated by said clamping means after said yarn is clamped for providing a first signal to move said feed roller out of engagement with said driven roller and for providing a second signal to said pullback mechanism to draw yarn back from said needle.

6. In apparatus as recited in claim 1, wherein said means for moving said feed roller into and out of engagement with said driven roller comprises a pivotably mounted lever, means for rotatably mounting said feed roller on said lever, and actuator means operatively connected to said lever for pivoting said lever selectively to force said roller into and out of peripheral engagement with said driven roller.

7. In apparatus as recited in claim 6, wherein said pullback mechanism includes a movable passageway through which said yarn is threaded, and means for moving said movable passageway to shorten the path of said yarn from said feed roller to said needle when said yarn is fed toward said needle and to increase said path when said yarn is not fed toward said needle.

8. In apparatus as recited in claim 6, including clamping means disposed intermediate said feed roller and said pullback mechanism for clamping said yarn when not fed by said roller and for releasing said yarn when fed by said roller.

9. In apparatus as recited in claim 7, including clamping means disposed intermediate said feed roller and said pullback mechanism for selectively clamping said yarn prior to moving said movable passageway to increase said path and for unclamping and releasing said yarn when said path is shortened by said movable passageway.

10. In apparatus as recited in claim 9, including signaling means associated with and activated by said clamping means after said yarn is clamped for providing a signal to move said feed roller out of engagement with said driven roller and for providing a signal to said pullback mechanism to draw yarn back from said needle.

11. Apparatus for producing patterned tufted fabric, comprising means for feeding a backing passed a stationary yarn applying region, a needle disposed for reciprocation at the yarn applying region for penetrating the backing and for implanting yarn therein, means for moving said backing transversely relative to said stationary yarn applying region for implanting yarn in a transverse row upon selective successive penetrations by said needle, and yarn feed means for feeding one yarn of a plurality of different yarns to said needle for implantation into said backing upon penetration thereof by said needle, said yarn feed means comprising a driven roller, a yarn feed roller disposed for movement into and out of peripheral engagement with said driven roller, means for guiding said yarn about said feed roller intermediate peripheral surfaces of said rollers, means for moving said feed roller into and out of engagement with said driven roller selectively to feed said yarn in a path from said feed roller toward said needle when said rollers engage, and a yarn pullback mechanism for permitting said yarn to be fed toward said needle when said yarn is fed by said feed roller and having means movable independently of said feed roller for drawing yarn back from said needle after a stitch has been formed by said needle and said needle no longer requires said yarn, said pullback mechanism including storage means for maintaining drawn back yarn for subsequent use as required by said needle.

12. Apparatus as recited in claim 11, wherein said pullback mechanism includes a movable passageway through which said yarn is threaded, and means for moving said movable passageway to shorten the path of said yarn from said feed roller to said needle when said yarn is fed toward said needle and to increase said path when said yarn is not fed toward said needle.

13. Apparatus as recited in claim 11, including clamping means disposed intermediate said feed roller and said pullback mechanism for clamping said yarn when not fed by said roller an for releasing said yarn when fed by said roller.

14. Apparatus as recited in claim 12, including clamping means disposed intermediate said feed roller and said pullback mechanism for selectively clamping said yarn prior to moving said movable passageway to increase said path and for unclamping and releasing said yarn when said path is shortened by said movable passageway.

15. Apparatus as recited in claim 14, including signaling means associated with and activated by said clamping means after said yarn is clamped for providing a signal to move said feed roller out of engagement with said driven roller and for providing a signal to said pullback mechanism to draw yarn back from said needle.

16. Apparatus as recited in claim 11, wherein said means for moving said feed roller into and out of engagement with said driven roller comprises a pivotably mounted lever, means for rotatably mounting said feed roller on said lever, and actuator means operatively connected to said lever for pivoting said lever selectively to force said roller into and out of peripheral engagement with said driven roller.

17. Apparatus as recited in claim 16, wherein said pullback mechanism includes a movable passageway through which said yarn is threaded, and means for moving said movable passageway to shorten the path of said yarn from said feed roller to said needle when said yarn is fed toward said needle and to increase said path when said yarn is not fed toward said needle.

18. Apparatus as recited in claim 16, including clamping means disposed intermediate said feed roller and said pullback mechanism for clamping said yarn when not fed by said roller and for releasing said yarn when fed by said roller.

19. Apparatus as recited in claim 17, including clamping means disposed intermediate said feed roller and said pullback mechanism for selectively clamping said yarn prior to moving said movable passageway to increase said path and for unclamping and releasing said yarn when said path is shortened by said movable passageway.

20. Apparatus as recited in claim 19, including signaling means associated with and activated by said clamping means after said yarn is clamped for providing a signal to move said feed roller out of engagement with said driven roller and for providing a signal to said pullback mechanism to draw yarn back from said needle.

* * * * *